US006296467B1

(12) United States Patent
Rouillard

(10) Patent No.: US 6,296,467 B1
(45) Date of Patent: Oct. 2, 2001

(54) VIBRATING SCREED FOR SURFACING CONCRETE

(75) Inventor: Roger Rouillard, Charlesbourg (CA)

(73) Assignee: Les Betons Roger Rouillard Inc., Charlesbourg (CA)

( * ) Notice: Subject to any disclaimer, the term of this patent is extended or adjusted under 35 U.S.C. 154(b) by 0 days.

(21) Appl. No.: 09/250,265

(22) Filed: Feb. 16, 1999

(51) Int. Cl.[7] ..... E01C 19/22

(52) U.S. Cl. ..... 425/182; 425/456; 425/458; 16/430; 404/118

(58) Field of Search ..... 425/456, 458, 425/470, 472, 182; 404/97, 103, 118, 133.05; 16/112.1, 113.1, 421, 430

(56) References Cited

U.S. PATENT DOCUMENTS

| | | | | |
|---|---|---|---|---|
| 1,829,467 | * | 10/1931 | Atkinson | 16/112.1 |
| 4,838,730 | * | 6/1989 | Owens | 404/114 |
| 4,848,961 | | 7/1989 | Rouillard | 404/114 |
| 4,861,188 | | 8/1989 | Rouillard | 404/75 |
| 5,375,942 | * | 12/1994 | Lindley et al. | 404/97 |
| 5,803,656 | * | 9/1998 | Turck | 404/103 |

OTHER PUBLICATIONS

Merriam–Webster's Collegiate Dictionary 10th Edition; Merriam–Webster Inc. 1999; p. 1022.*

* cited by examiner

*Primary Examiner*—James P. Mackey
*Assistant Examiner*—Donald Heckenberg

(57) ABSTRACT

A vibrating screed for surfacing concrete comprises a surfacing blade, a pair of handle assemblies mounted to said blade, a motor, vibration causing mechanism and a transmission connecting the motor to the vibration causing mechanism such that, when the motor is in operation it causes the transmission to rotate with the transmission being adapted to impart a vibratory motion to the blade. The transmission includes a flexible joint having an angled configuration to allow the motor to be mounted rearwardly of a leading edge of the blade. Each handle assembly comprises a main elongated tubular member and a handle mounted at a proximal end thereof. The handle includes a first tubular element mounted around the main tubular member, a second tubular element extending sideways from the first element and a third tubular element extending around the second element, with a grip member being mounted to the third element. The first element is capable of relative rotatable and translational displacement with respect to the main tubular member, and the third element and grip member are capable of rotational displacement relative to the second element. Clamps are provided for securing the first and third tubular elements in selected positions relative to the main tubular member and to the second tubular element, respectively.

19 Claims, 4 Drawing Sheets

VIBRATING SCREED FOR SURFACING CONCRETE

BACKGROUND OF THE INVENTION

1. Field of the Invention

The present invention relates to devices for surfacing concrete and, more particularly, to vibrating screeds for concrete surfacing of the type having an elongated blade mounted transversally at the bottom of a pair of hand held handles with a motor being adapted to transmit to the blade a vibratory movement.

2. Description of the Prior Art

Conventional vibrating screeds comprise, for instance, an elongated blade extending horizontally and transversally at lower ends of a pair of handles adapted to be hand held and operated for displacing the screed over a concrete surface. A motor is provided above the blade and between the handles and has its shaft extending vertically downwards from the motor to the blade and is connected thereat such that, with a counterweight or a cam-like arrangement, it imparts oscillatory movement to the blade of high frequency but low amplitude.

The pair of handles permit an easy and constant correction of the level of the concrete with minimum effort. The blade may have different lengths, for example between 4 and 12 feet. A throttle control of the motor is provided at one of the handles such that the speed of the motor may be monitored and adjusted as the blade is displaced over the concrete being surfaced.

For instance, U.S. Pat. No. 4,861,188 issued to Rouillard on Aug. 29, 1989 discloses a method and an apparatus for compacting and smoothing freshly poured concrete during the construction of a floor or other flat surface. The apparatus is a screed divided in two portions. The first portion is used to level, compact and remove excess concrete and the second portion allows the screed to float on the freshly poured and soft concrete.

U.S. Pat. No. 4,848,961 issued to Rouillard on Jul. 18, 1989 discloses a concrete screeding apparatus and, more particularly, an improved portable and lightweight vibrating concrete screed enabling a workman to use same without the need for rigid forms. The screeding apparatus comprises a generally elongated beam having a horizontal surface and a generally vertical surface. A plurality of vibrators are mounted on the beam. The height of the vertical surface diminishes from the centre to the edges so as to increase the amplitude of vibration and, therefore, improve the manoeuvrability of the screed. In addition, the corners formed by the trailing edge and the side edges of the horizontal surface are rounded so as to avoid the penetration of the side edges into the freshly poured concrete.

SUMMARY OF THE INVENTION

It is therefore an aim of the present invention to provide an improved screed for surfacing concrete.

It is also an aim of the present invention to provide such a concrete surfacing screed having adjustable handles.

Therefore, in accordance with the present invention, there is provided a vibrating device for surfacing concrete, comprising a surfacing blade, handle means mounted to said blade, a motor, vibration causing means and transmission means connecting said motor to said vibration causing means, wherein when said motor is in operation it causes said transmission means to rotate with said transmission mans being adapted to impart a vibratory motion to said blade, said transmission means comprising a flexible joint means having first and second sections having longitudinal axes angled to each other.

Also in accordance with the present invention, there is provided a vibrating device for surfacing concrete, comprising a surfacing blade, handle means mounted to said blade, a motor, vibration causing means and transmission means connecting said motor to said vibration causing means, wherein when said motor is in operation it causes said transmission means to rotate with said transmission means being adapted to impart a vibratory motion to said blade, said handle means comprising a main elongated handle member and a handle mounted at a proximal end thereof, said handle having a first element releasably mounted to said main handle member and being adapted to swivel at least partly around an axis of said main handle member.

Further in accordance with the present invention, there is provided a vibrating device for surfacing concrete, comprising a surfacing blade, handle means mounted to said blade, a motor, vibration causing means and transmission means connecting said motor to said vibration causing means, wherein when said motor is in operation it causes said transmission means to rotate with said transmission mans being adapted to impart a vibratory motion to said blade, said handle means comprising a main elongated handle member and a handle, said handle having a first element mounted to a proximal end of said main handle member, said handle having second and third elements capable of relative rotatable displacement and capable of being secured in a desired relative position thereof with a grip member being mounted to said third element such that said grip member may be swiveled at least partly around an axis of said second element.

BRIEF DESCRIPTION OF THE DRAWINGS

Having thus generally described the nature of the present invention, reference will now be made to the accompanying drawings, showing by way of illustration a preferred embodiment thereof and in which.

DESCRIPTION OF THE PREFERRED EMBODIMENTS

Figure 1:
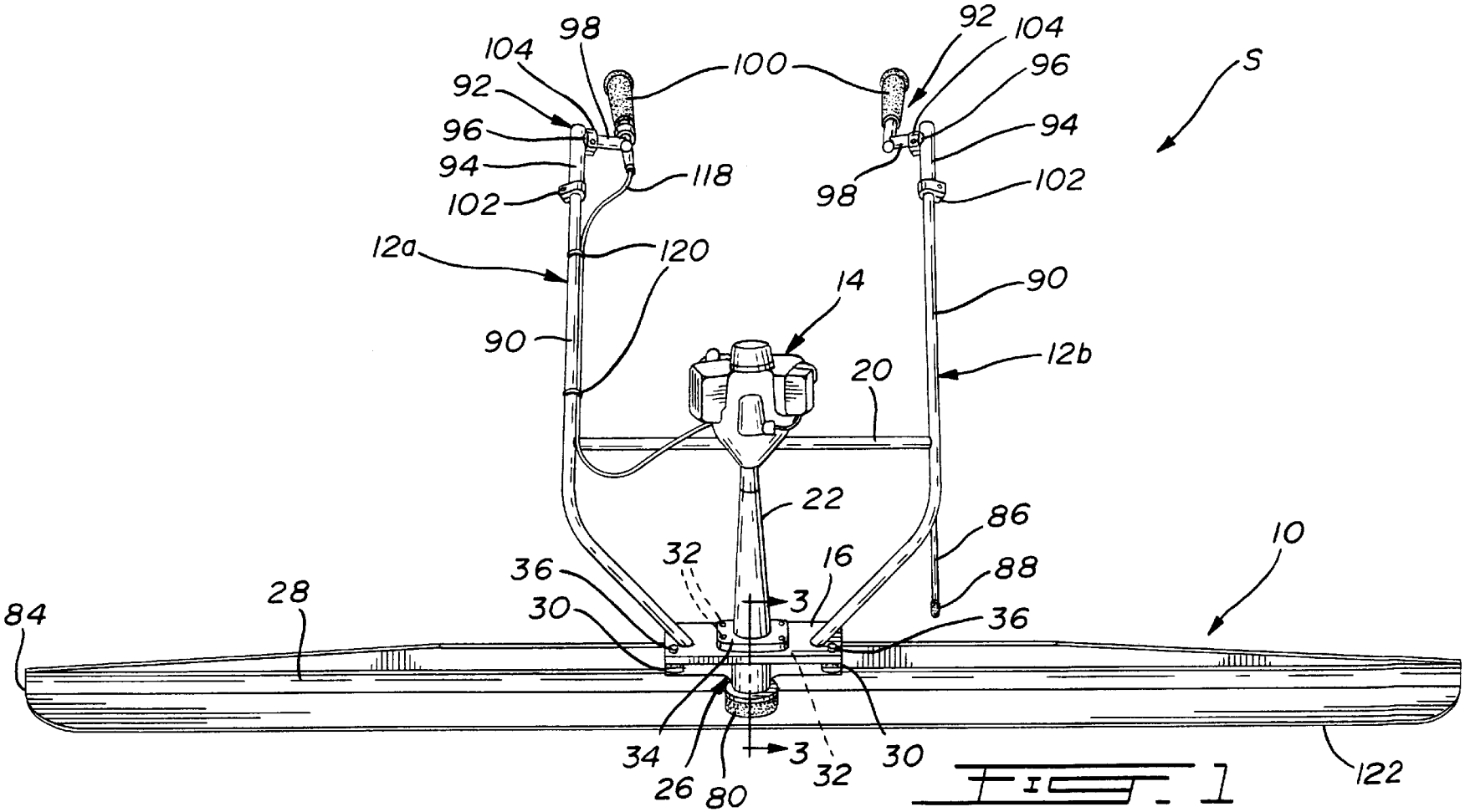
FIG. 1 is a front elevational view of a vibrating screed in accordance with the present invention.

FIG. 1 illustrates a vibrating screed S in accordance with the present invention and generally comprising an elongated surfacing blade 10, a pair of handle assemblies 12*a* and 12*b* extending upwardly and rearwardly from the blade 10, and a motor 14 for imparting vibratory movement to the blade 10 such that, when the blade 10 is displaced over a not yet set concrete surface, it surfaces, i.e. smoothens, this concrete surface. The motor 14 may be powered by gasoline or other fuels and may also by electric.

Figure 3:
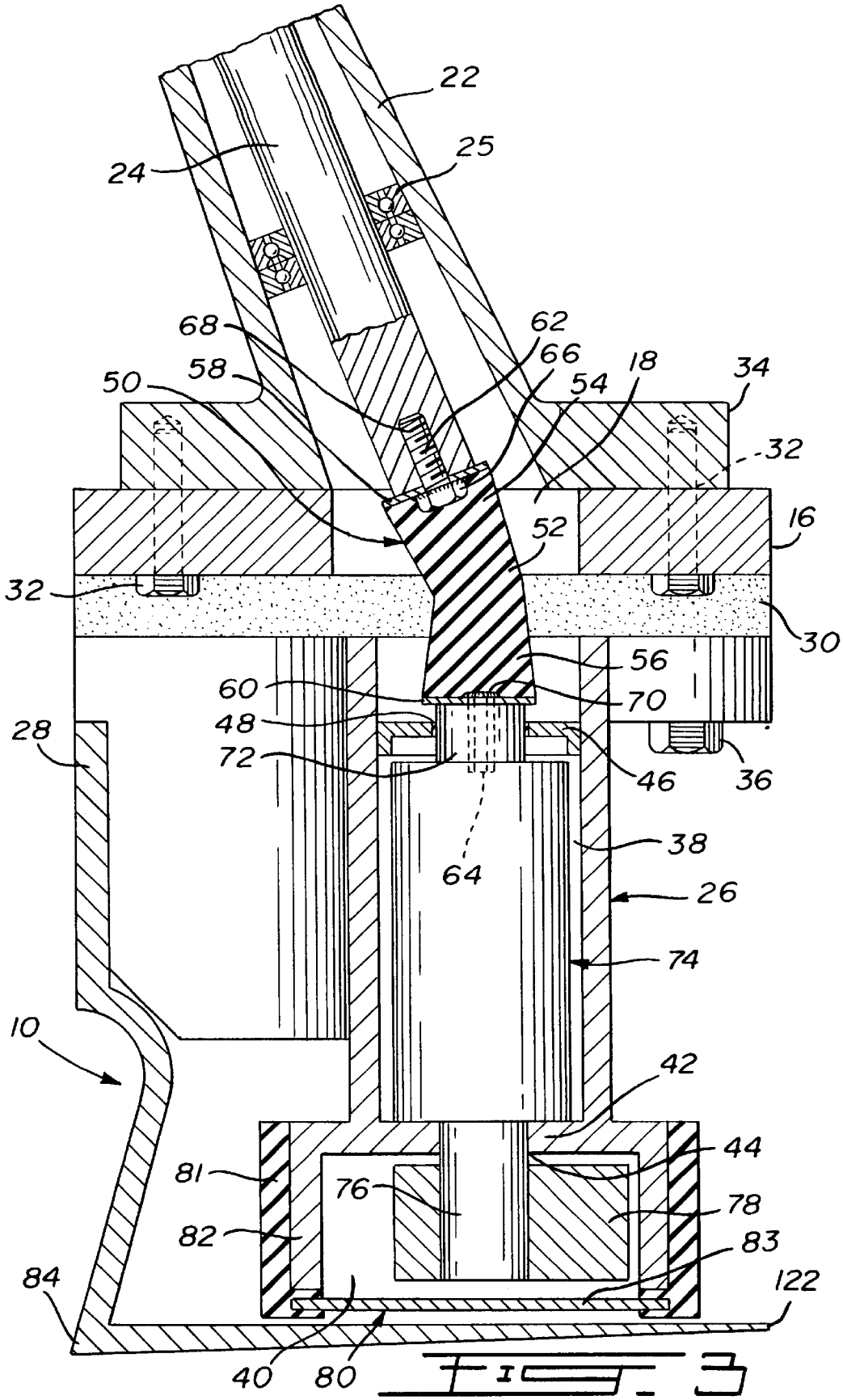
FIG. 3 is a cross-sectional view taken along line 3—3 of FIG. 1.

More particularly, the handle assemblies 12*a* and 12*b*, which are spaced apart along the orientation of the blade 10, are mounted at their lower ends to a plate 16 which defines a circular hole 18 (see FIG. 3) and are further attached together by a cross bar 20. The motor 14 is mounted atop a shaft housing 22 within which extends a drive shaft 24, as seen in FIG. 3. The drive shaft 24 is rotatably driven by the motor 14 and is supported in the shaft housing 22 by a pair of bearings and circlips (snap rings) herein generally identified together at 25.

A housing weight 26, which is mounted to a rear vertical wall 28 of the blade 10 with nut and bolts (not shown), is also secured at an upper surface thereof to the plate 16 with a pair of elongated rubber or rubber-like "vibro mounts" or cushions 30 extending between the plate 16 and the housing weight 26 such as to reduce a transmission of the vibrations produced by the motor 14 at the level of the blade 10 to the handle assemblies 12*a* and 12*b*. Bolts 32 secure the plate 16 to a lower enlarged end 34 of the shaft housing 22, the bolts 32 being tapped in the enlarged end 34 and thus not being visible in FIG. 1 although their general locations have been identified in broken lines in FIG. 1 for clarity of illustration purposes. Headless bolts with pairs of nuts at their opposed ends or standard nuts and bolts 36 extend through the housing weight 26, the cushions 30 and the plate 16 to secure these components together.

Now referring mainly to FIG. 3, the housing weight 26 defines an upper cylindrical chamber 38, a lower cylindrical chamber 40 which is shorter but of greater diameter then the upper chamber 38, and a horizontal lower partition wall 42 between the upper and lower chambers 38 and 40, this lower partition wall 42 defining a circular opening 44. An upper partition wall 46 extends horizontally across an upper portion of the upper chamber and itself defines a circular opening 48.

Figure 2:
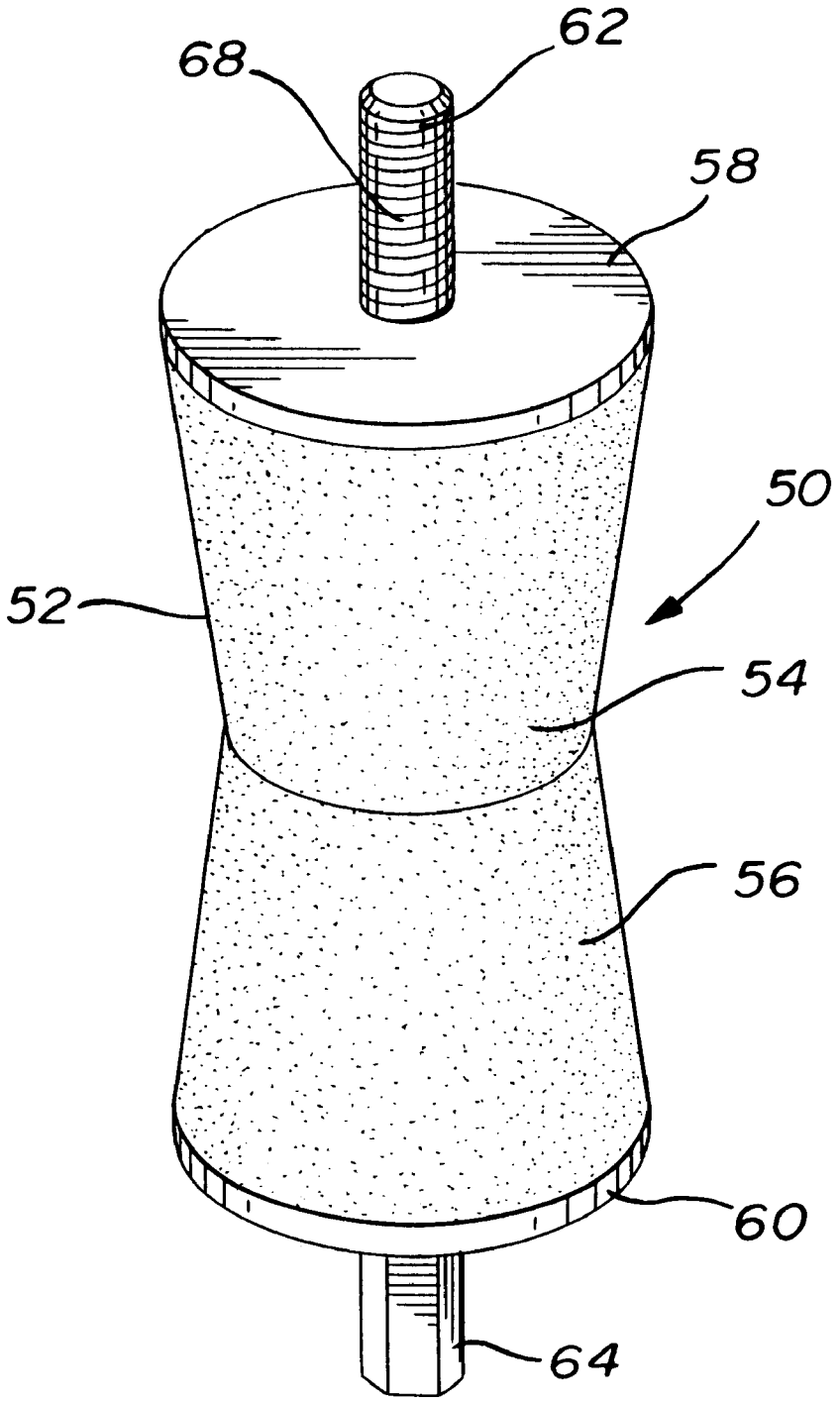
FIG. 2 is an enlarged perspective view of a flexible joint or drive axle of the motor shaft of the vibrating screed of FIG. 1.

A flexible joint, coupling or drive axle 50 which is shown in detail in FIG. 2 includes an integral resilient hard rubber main body 52 having opposed frusto-conical upper and lower sections 54 and 56, respectively, upper and lower metal discs or washers 58 and 60, respectively, and upper bolt 62 and a lower hexagonal, i.e. Allen key-like, pin 64. As seen in FIG. 3, a head 66 of the bolt 62 is embedded in the upper section 52 of the main body 52 of the drive axle 50 and extends outwardly therefrom through the upper washer 58 such that a threaded stem 68 of the bolt 62 is threadably engaged to the drive shaft 24. The head 66 of the bolt 62 is welded to the upper washer 58.

The hexagonal pin 64 is fixed by welding at its upper end 70 to the lower washer 60 with the lower washer 60 being fixed to the lower section 56 of the main body 52 of the drive axle 50 such that the hexagonal pin 64 extends through the lower washer 60 and into a mating hexagonal aperture defined in an upper end 72 of a shaft assembly 74 which extends in the upper and lower chambers 38 and 40, respectively. This upper end 72 extends through and is journaled in the upper opening 48 defined in the upper partition wall 46. A lower end 76 of the shaft assembly 74 extends through and is journaled in the lower opening 44 defined in the lower partition wall 42. A counter weight 78 is eccentrically mounted in the lower chamber 40 to the lower end 76 of the shaft assembly 74.

A cover 80 is mounted exteriorly around a wall 82 of the housing weight 26 and transversally therebelow for closing the lower end of the housing weight 26. The cover 80 includes a rubber seal 81 to ensure a seal at the lower end of the wall 82 and an aluminum disc 83 extending inwardly of the seal 81. The cover 80 prevents dirt and other foreign matters from accessing the lower chamber 40 and possibly damaging the rotating vibration causing counterweight 78 and a transmission mechanism which links the motor 14 to the counterweight 78 and which generally includes the drive shaft 24, the flexible drive axle 50 and the shaft assembly 74.

Accordingly, when in operation, the motor 14 causes the rotation of the drive shaft 24 which itself causes the drive axle 50 to rotate as being fixedly secured thereto by the bolt 62. The drive axle 50 in turn rotatably drives the shaft assembly 74 by way of the hexagonal pin 64 with the shaft assembly 74 causing a rotation of the counter weight 78 which, due to its eccentricity, imparts vibration to the housing weight 26 and thus to the blade 10 mounted thereto. The cushions 30 again reduce the amount of vibrations transmitted to the handle assemblies 12*a* and 12*b*.

The lower section 56 of the drive axle 50 extends substantially vertically, whereas the upper section 54 thereof extends upwardly and rearwardly and coaxially with the drive shaft 24 which is angled approximately at 22° with respect to the vertical. This configuration allows for the motor 14 to be rearwardly offset from the blade 10 such as not to interfere with obstacles, such as walls and the like, when the blade 10 of the vibrating screed S is displaced near, along or around such obstacles. Also, the drive axle 50 and the ensuing angle of the drive shaft 24 results in that the motor 14 is positioned over a cutting portion 84 of the blade 10 which is beneficial to the handling and performance of the vibrating screed S and provides an overall balance therein.

As seen in FIG. 1, the vibrating screed S is provided with a support stand 86 which is pivotally mounted at its upper end to the handle assembly 12*b*. The support stand 86 is herein shown in its collapsed, or storage, position along the handle assembly 12*b*, and is retained in this position by a releasable clip (not shown). Once released from this clip, the support stand may be pivoted away from the handle assembly 12*b* and a rubber foot 88 thereof may then engage the ground such as to support the vibrating screed S in a position similar to that shown in FIG. 1.

Figure 4:
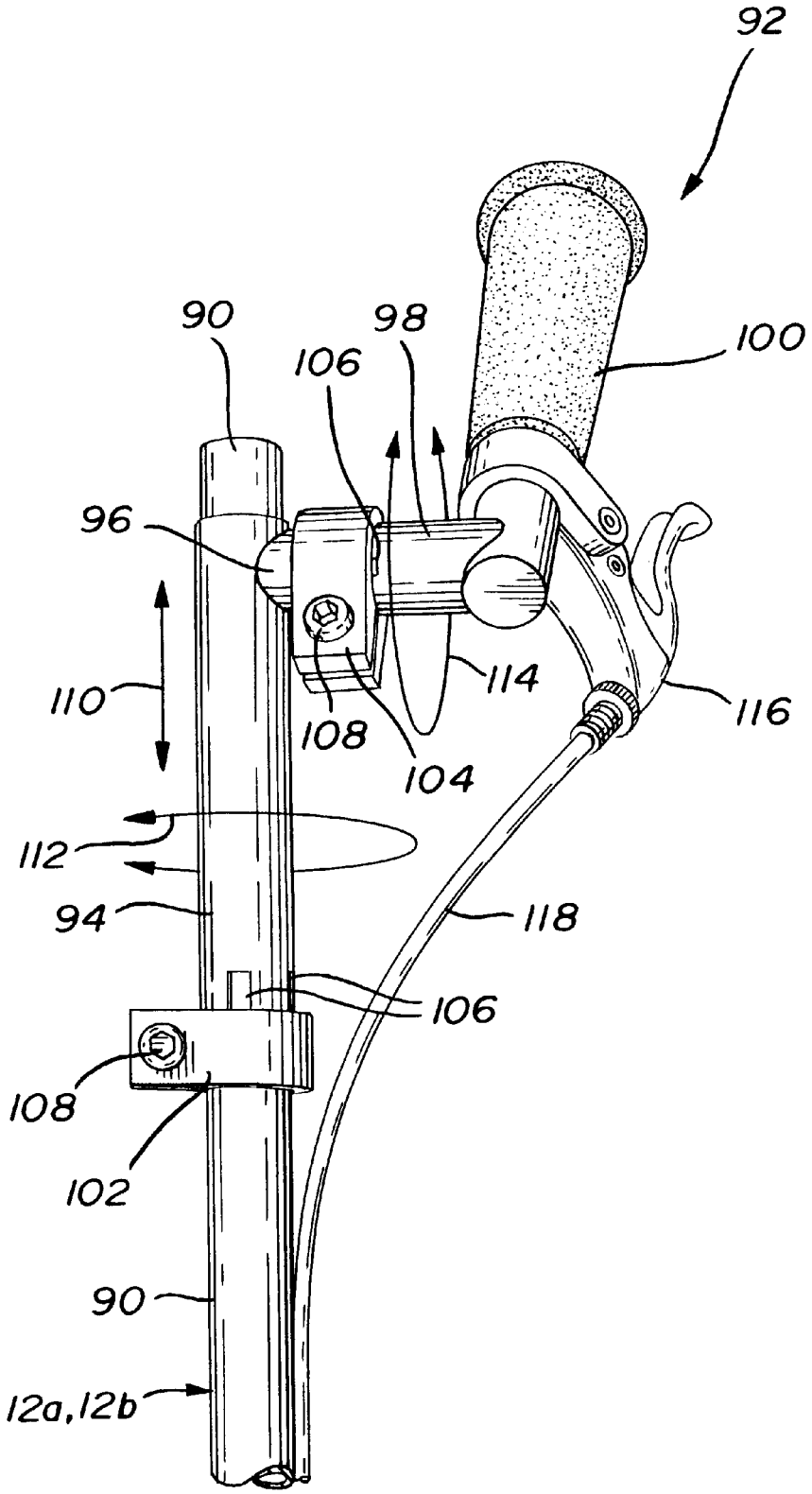
FIG. 4 is a front elevational view of an upper part of the vibrating screed and showing one of the adjustable handles thereof.

Now referring to FIG. 1 and mainly to FIG. 4, each handle assembly 12*a* and 12*b* is provided with an elongated main tubular member 90 which is elbowed at its lower third so as to be directed inwardly towards and up to the plate 16, and is also provided with an adjustable handle 92. The handle 92 includes a first tubular element 94 slidably mounted over the tubular member 90, a second tubular element 96 fixedly mounted to the first tubular element 94 and extending at right angles thereto, a third tubular element 98 slidably mounted over the second tubular element 96, and a textured rubber grip member 100 fixedly mounted to the third tubular element 98 and extending at right angles thereto. First and second releasable clamps 102 and 104, respectively, are provided around the first and third tubular elements 94 and 98, respectively.

The first and third tubular elements 94 and 98 define notches or slots 106 in their respective walls in order to allow them to compress respectively onto the tubular member 90 and the second tubular element 96 when the jaws of the clamps 102 and 104 are brought closer together using nuts 108 which define Allen key type recesses. When the first clamp 102 is loose, the first tubular element 94 may be displaced translationally along the tubular member 90 (see arrows 110) and may also be rotated with respect thereto as per arrows 112 such that whole handle 92 may be swiveled around the tubular member 90 until a user's preferential position, whereat the nut 108 of the first clamp 104 is rotated clockwise such as to cause the jaws of the clamp 104 to tightly bring the slotted portion of first tubular element 94 in secure frictional engagement with the tubular member 90.

Similarly, when the second clamp 104 is loose, the third tubular element 98 may be rotated around the tubular member 90 (see arrows 114) such as to adjust the angular position of the grip member 100 with respect to the tubular member 90 as per a user's preferential position, whereat the nut 108 of the second clamp 104 is rotated clockwise such as to cause the jaws of the clamp 104 to tightly bring the slotted portion of third tubular element 98 in secure frictional engagement with the second tubular element 96.

The handle 92 of one of the handle assemblies 12*a* and 12*b* is provided with a throttle control 116 connected to a throttle cable 118 extending to the motor 14. Tie wraps 120 are used to attach the cable 118 to the tubular member 90 of this handle assembly (i.e. handle assembly 12*a* in FIG. 1). The blade 10 has a leading edge 122.

The embodiments of the invention in which an exclusive property or privilege is claimed are defined as follows:

1. A vibrating device for surfacing concrete, comprising a surfacing blade, steering means mounted to said blade, a motor, vibration causing means and a transmission connecting said motor to said vibration causing means, wherein when said motor is in operation it causes said transmission to rotate with said transmission imparting a vibratory motion to said blade, said transmission comprising a flexible joint having substantially straight first and second sections having longitudinal axes angled to each other and intersecting each other within said flexible joint.

2. A vibrating device as defined in claim 1, wherein said first and second sections of said flexible joint comprise upper and lower sections, said lower section of said flexible joint extending substantially vertically above said vibration causing means and said blade, whereas said upper portion extends upwardly and rearwardly at an angle, said transmission also comprising a drive shaft mounted between said motor and said flexible joint, whereby said motor is mounted rearwardly of a leading edge of said blade.

3. A vibrating device as defined in claim 2, wherein said upper and lower sections of said flexible joint are integral and are made of a resilient material at least where said joint is flexible.

4. A vibrating device for surfacing concrete, comprising a surfacing blade, steering means mounted to said blade, a motor, vibration causing means and a transmission connecting said motor to said vibration causing means, wherein when said motor is in operation it causes said transmission to rotate with said transmission imparting a vibratory motion to said blade, said steering means comprising a main elongated handle member and a handle mounted at a proximal end thereof, said handle having a first element releasably mounted to said main handle member for swiveling, when in an unlocked position relative to said main handle member, at least partly around a longitudinal axis of said main handle member.

5. A vibrating device as defined in claim 4, wherein said first element is slidably displaceable along said main handle member.

6. A vibrating device for surfacing concrete, comprising a surfacing blade, steering means mounted to said blade, a motor, vibration causing means and a transmission connecting said motor to said vibration causing means, wherein when said motor is in operation it causes said transmission to rotate with said transmission imparting a vibratory motion to said blade, said steering means comprising a main elongated handle member and a handle, said handle having a first element mounted to a proximal end of said main handle member, said handle having second and third elements displaceable between locked and unlocked positions thereof, wherein in said locked position said second and third elements are rotatable relative to one another, whereas when in said unlocked position, said second and third elements are secured in a desired relative position, with a grip member being mounted to said third element such that said grip member may be swiveled at least partly around an axis of said second element.

7. A vibrating device as defined in claim 6, wherein said first element is releasably mounted to said main handle member for swiveling, when in an unlocked position relative to said main handle member, at least partly around an axis of said main handle member.

8. A vibrating device as defined in claim 7, wherein said first element is slidably displaceable along said main handle member.

9. A vibrating device as defined in claim 6, wherein said main handle member and said first element comprise concentrically disposed tubular members, said second and third elements comprising concentrically disposed tubular members, said second element extending substantially at right angles to said first element and said third element extending substantially at right angles to said grip member such that said grip member swivels in a plane substantially parallel to said axis of said main handle member, locking means being provided for retaining selected relative positions between said main handle member and said first element and between said second and third elements.

10. A vibrating device as defined in claim 1, wherein said first and second sections of said flexible joint taper towards each other.

11. A vibrating device as defined in claim 2, wherein said upper and lower sections of said flexible joint taper towards each other.

12. A vibrating device as defined in claim 3, wherein said upper and lower sections of said flexible joint taper towards each other.

13. A vibrating device as defined in claim 10, wherein said first and second sections of said flexible joint are each substantially frusto-conical shaped.

14. A vibrating device as defined in claim 11, wherein said upper and lower sections of said flexible joint are each substantially frusto-conical shaped.

15. A vibrating device as defined in claim 12, wherein said upper and lower sections of said flexible joint are each substantially frusto-conical shaped.

16. A vibrating device as defined in claim 1, wherein said first and second sections of said flexible joint are made of rubber.

17. A vibrating device as defined in claim 2, wherein said upper and lower sections of said flexible joint are made of rubber.

18. A vibrating device as defined in claim 3, wherein said upper and lower sections of said flexible joint are made of rubber.

19. A vibrating device as defined in claim 2, wherein said upper section is threadably engaged to said drive shaft with said lower section being keyed to said vibration causing means.

* * * * *